United States Patent [19]

Ishida

[11] Patent Number: 4,892,680

[45] Date of Patent: Jan. 9, 1990

[54] SYNTHETIC LUBRICATING OILS AND SPECIFIED NAPHTHALENE DERIVATIVES FOR USE THEREIN

[75] Inventor: Noboru Ishida, Kawasaki, Japan

[73] Assignee: Nippon Oil Co., Ltd., Tokyo, Japan

[21] Appl. No.: 294,374

[22] Filed: Jan. 6, 1989

[30] Foreign Application Priority Data

Jan. 11, 1988 [JP] Japan ..... 63-2545
Feb. 8, 1988 [JP] Japan ..... 63-25742

[51] Int. Cl.[4] ..... C10M 105/34
[52] U.S. Cl. ..... 252/565; 252/56 R
[58] Field of Search ..... 252/56 R, 56 S

[56] References Cited

FOREIGN PATENT DOCUMENTS 1155495 6/1986 Japan ..... 252/56 S

*Primary Examiner*—William R. Dixon, Jr.
*Assistant Examiner*—James M. Hunter, Jr.
*Attorney, Agent, or Firm*—Buchnam and Archer

[57] ABSTRACT

Synthetic lubricating oils comprising as the main component at least one member selected from the group consisting of specified naphthoic acid esters, naphthyl ethers and naphthol esters.

9 Claims, 5 Drawing Sheets

SYNTHETIC LUBRICATING OILS AND SPECIFIED NAPHTHALENE DERIVATIVES FOR USE THEREIN

BACKGROUND OF THE INVENTION

1. Field of the Invention

This invention relates to novel synthetic lubricating oils which are particularly excellent in oxidation resistance and contain as the main component at least one member selected from specified naphthoic acid esters, naphthyl ethers and naphthol esters, and it also relates to the novel specified naphthoic acid esters and naphthyl ethers for use in the novel synthetic lubricating oils.

2. Description of the Prior Art

Lubricating oils are generally required to have a long-term service life. To meet this requirement, a highly refined mineral oil to which a suitable antioxidant has been added as required, is used as a lubricating oil. The mineral oil, however, has limited oxidation resistance and is therefore difficult to use for a long period of time under severe circumstances. Thus, ester-based synthetic oils such as diesters and polyol esters as well as hydrocarbon synthetic oils such as $\beta$-olefins, have been developed and now widely used as lubricating oils having excellent oxidation stability.

These hitherto-known synthetic lubricating oils are deemed to have higher oxidation stability than the mineral oils, but their oxidation stability is not fully satisfactory.

SUMMARY OF THE INVENTION

An object of this invention is to provide a novel synthetic lubricating oil having particularly excellent oxidation stability and a long-term stable service life.

Another object of this invention is to provide novel specified naphthalene derivatives having high oxidation stability for use in said novel lubricating oils.

The present inventor made various studies in an attempt to develop the novel synthetic lubricating oils and the novel specified compounds for use therein in order to achieve said objects and, as the results of the various studies, he has found that synthetic lubricating oils containing as the main component at least one member selected from specified naphthoic acid esters, naphthyl ethers and naphthol esters, have particularly high oxidation stability as compared with the known synthetic lubricating oils and that said novel specified naphthoic acid esters and naphthyl ethers exhibit high oxidation stability. This invention is based on these findings.

In one aspect, the synthetic lubricating oil of this invention is characterized by containing as the main component a specified naphthoic acid ester represented by the following general formula

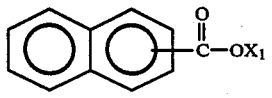

wherein $X_1$ is an alkyl group having 1–20 carbon atoms or is a group having the formula

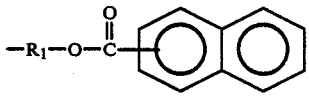

in which $R_1$ is an alkylene group having 2–20 carbon atoms.

In another aspect, the synthetic lubricating oil of this invention is characterized by containing as the main component a naphthyl ether represented by the formula

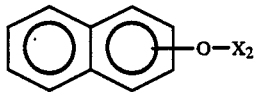

wherein $X_2$ is an alkyl group having 1–20 carbon atoms, a phenyl group, a monoalkylphenyl group having 7–26 carbon atoms or a group having the formula

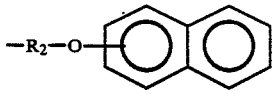

in which $R_2$ is an alkylene group having 2–20 carbon atoms.

In a further aspect, the synthetic lubricating oil of this invention is characterized by containing as the main component a naphthol ester represented by the general formula

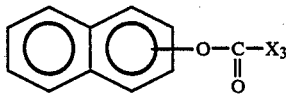

wherein $X_3$ is an alkyl group having 1–20 carbon atoms or is a group having the general formula

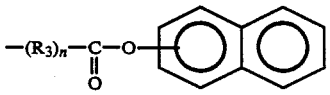

in which $R_3$ is an alkylene group having 1–20 carbon atoms and n is 0 or 1.

In a still further aspect, the synthetic lubricating oil of this invention is characterized by containing as the main components two or more selected from said specified naphthoic acid esters, naphthyl ethers and naphthol esters.

This invention will be explained in more detail hereunder.

The naphthoic acid esters used herein include alkyl naphthoates which may be either in the $\alpha$-form represented by the general formula

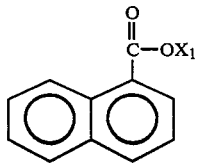

wherein $X_1$ is as defined before, or in the $\beta$-form represented by the general formula

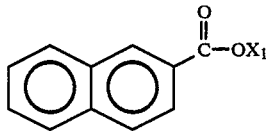

wherein $X_1$ is as defined before, among which two forms the $\alpha$-form is more preferred from the viewpoint of its oxidation stability and easy availability.

The naphthoic acid esters also include alkylene dinaphthoates which may be:

in the $\alpha,\alpha$-form represented by the formula

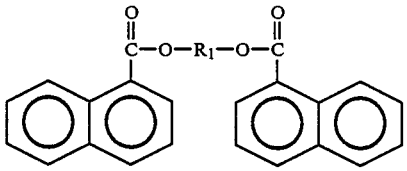

wherein $R_1$ is an alkylene group having 2–20 carbon atoms, in the $\alpha,\beta$-form represented by the formula

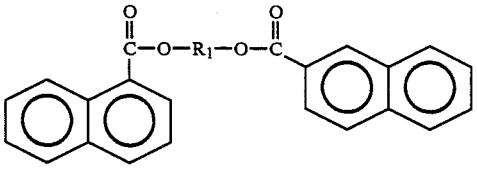

wherein $R_1$ is as defined before, or in the $\beta,\beta$-form represented by the formula

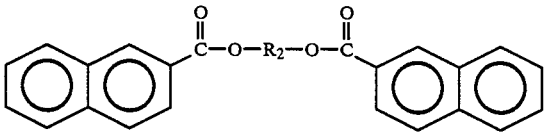

wherein $R_2$ is an alkylene group having 2–20 carbon atoms. Among the alkylene dinaphthoates, those in the $\alpha,\alpha$-form are more preferred from the viewpoint of their oxidation stability and easy availability.

In the naphthoic acid esters used herein, the carbon number, represented by $X_1$, of the alkyl group is required to be 1–20, preferably 4–18; the carbon number, represented by $R_1$, of the alkylene group is required to be 2–20, preferably 2–12. Naphthoic acid esters in which $X_1$ is outside said range, are undesirably inferior in oxidation stability to those used in this invention, and, further, the former esters will form a lubricating oil having undesirably unsatisfactory physical properties when contained in the lubricating oil as compared with the latter.

In addition, the naphthyl ethers used in the synthetic lubricating oil may be either in the o-substituted form represented by the formula

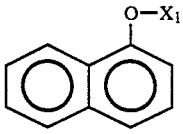

wherein $X_1$ is as defined before, or in the $\beta$-substituted form represented by the formula

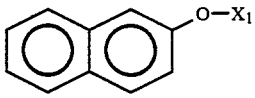

wherein $X_1$ is as defined before. Among these substituted compounds, those in the $\alpha$-substituted form are preferred from the standpoint of their easy availability and their physical properties as the main component of the lubricating oil.

In the naphthyl ethers, it is necessary that the group represented by $X_2$ be an alkyl group having 1–20, preferably 4–18, carbon atoms, a phenyl group, a monoalkylphenyl group having 7–26, preferably 7–24, carbon atoms or a group represented by the formula

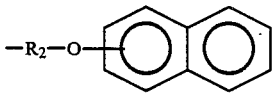

wherein $R_2$ is an alkylene group having 2–20, preferably 4–16, carbon atoms. As compared with the naphthyl ethers of this invention, naphthyl ethers which do not meet the above requirements, are unsatisfactory in oxidation stability and will produce a lubricating oil having unsatisfactory physical properties when used in the preparation of the lubricating oil, this being undesirable.

Further, among these groups represented by $X_2$, the alkylphenyl group is required to be a monoalkylphenyl group. It is undesirable that naphthyl ethers having a polysubstituted alkylphenyl group are unsatisfactory in oxidation stability and will produce a lubricating oil having unsatisfactory physical properties when used in the preparation of the lubricating oil. The monoalkylphenyl group of the naphthyl ethers of this invention may preferably be in the ortho-substituted form from the viewpoint of their oxidation stability and the physical properties of a lubricating oil containing the naphthyl ether, but it may also be in the meta-substituted or para-substituted form.

The group represented by the general formula

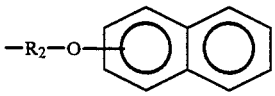

may be in the $\alpha$-substituted form having the general formula

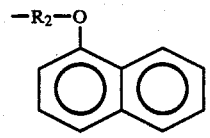

wherein $R_2$ is as defined above, or in the β-substituted form having the general formula

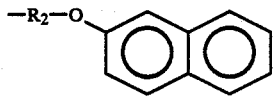

wherein $R_2$ is as defined before. Among these two substituted forms, the α-substituted form is preferred from the standpoint of the easy availability of the starting material and the physical properties of the resulting lubricating oil.

The naphthol esters used in this invention may be in the α-substituted form represented by the general formula

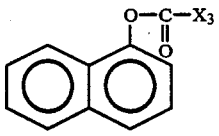

wherein X is as defined above, or in the β-substituted form represented by the general formula

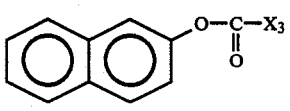

wherein $X_3$ is as defined above. Among these two forms, the α-substituted form is preferred since the starting material is easily available and the resulting lubricating oil has satisfactory physical properties.

It is necessary that the group represented by $X_3$ be either an alkyl group having 1–20, preferably 4–18, carbon atoms or a group having the general formula

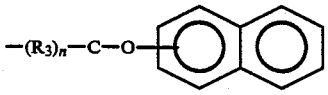

wherein $R_3$ is an alkylene group having 1–20, preferably 4–16, carbon atoms and n is 0 or 1. Naphthol esters which do not meet the above requirements, exhibit low oxidation stability and the resulting lubricating oil has unsatisfactory physical properties, as compared with the naphthol esters used in this invention. The group represented by $X_3$ represented by the general formula

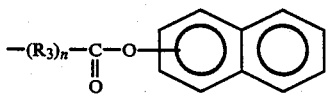

wherein $R_3$ is as defined above, may be either in the α-substituted form having the general formula

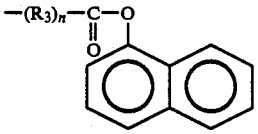

wherein $R_3$ is as defined above, or in the β-substituted form having the general formula

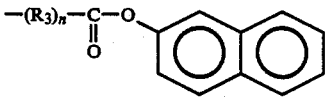

wherein $R_3$ is as defined above. Among these two forms, the α-substituted form is preferred since the starting material is easily available and the resulting lubricating oil has satisfactory physical properties.

The alkyl group among the groups represented by $X_1$ in the naphthoic acid esters, the alkyl group and the alkyl group of the alkylphenyl group among the groups represented by $X_2$ in the naphthyl ethers, and the alkyl group among the groups represented by $X_3$ in the naphthol esters, as well as the alkylene group represented by $R_1$, $R_2$ or $R_3$ in said ethers and esters, may each be in the straight-chain or branched-chain form.

The alkyl group among the groups represented by $X_1$ in the naphthoic acid esters, the alkyl group and the alkyl group of alkylphenyl group among the groups represented by $X_2$ in the naphthyl ethers, or the alkyl group among the groups represented by $X_3$ in the naphthol esters, preferably includes butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, sec-butyl, 1-methylbutyl, 1-ethylpropyl, 1-methylpentyl, 1-ethylbutyl, 1-methylhexyl, 1-ethylpentyl, 1-propylbutyl, 1-methylheptyl, 1-ethylhexyl, 1-propylpentyl, 1-methyloctyl, 1-ethylheptyl, 1-propylhexyl, 1-butylpentyl, 1-methylnonyl, 1-ethyloctyl, 1-propylheptyl, 1-butylhexyl, 1-methyldecyl, 1-ethylnonyl, 1-propyloctyl, 1-butylheptyl, 1-pentylhexyl, 1-methylundecyl, 1-ethyldecyl, 1-propylnonyl, 1-butyloctyl, 1-pentylheptyl, 1-methyldodecyl, 1-ethylundecyl, 1-propyldecyl, 1-butylnonyl, 1-pentyloctyl, 1-hexylheptyl, 1-methyltridecyl, 1-ethyldodecyl, 1-propylundecyl, 1-butyldecyl, 1-pentylnonyl, 1-hexyloctyl, 1-methyltetradecyl, 1-ethyltridecyl, 1-propyldodecyl, 1-butylundecyl, 1-pentyldecyl, 1-hexylnonyl, 1-heptyloctyl, 1-methylpentadecyl, 1-ethyltetradecyl, 1-propyltridecyl, 1-butyldodecyl, 1-pentylundecyl, 1-hexyldecyl, 1-heptylnonyl, 1-methylhexadecyl, 1-ethylpentadecyl, 1-propyltetradecyl, 1-butyltridecyl, 1-pentyldodecyl, 1-hexylundecyl, 1-heptyldecyl, 1-octylnonyl, 1-methylheptadecyl, 1-ethylhexadecyl, 1-propylpentadecyl, 1-butyltetradecyl, 1-pentyltridecyl, 1-hexyldodecyl, 1-heptylundecyl, 1-octyldecyl, tert-butyl, tert-amyl, 1,1-dimethylbutyl, 1-ethyl-1-methylpropyl, 1,1-dimethylpentyl, 1-ethyl-1-methylbutyl, 1,1-diethylpropyl, 1,1-dimethylhexyl, 1-ethyl-1-methylpentyl, 1,1-diethylbutyl, 1,1-dimethylheptyl, 1-ethyl-1-methylhexyl, 1,1-diethylpentyl, 1,1-dimethyloctyl, 1-ethyl-1-methylheptyl, 1,1-diethylhexyl, 1,1-dimethylnonyl, 1-ethyl-1-methyloctyl, 1,1-diethylheptyl, 1,1-dimethyldecyl, 1-ethyl-1-methylnonyl, 1,1-diethyloctyl, 1,1-dimethylundecyl, 1-ethyl-1-methyldecyl, 1,1-diethylnonyl, 1,1-dimethyldodecyl, 1-ethyl-1-methylundecyl, 1,1-diethyldecyl, 1,1-dimethyltridecyl, 1-ethyl-1-methyldodecyl, 1,1-diethylundecyl, 1,1-dimethyltetradecyl, 1-ethyl-1-methyltridecyl, 1,1-diethyldodecyl, 1,1-dimethylpentadecyl, 1-ethyl-1-methyltetradecyl, 1,1-diethyltridecyl, 1,1-dimethylhexadecyl, 1-ethyl1-methylpentadecyl, 1,1-diethyltetradecyl, 2-ethylhexyl, 2-hexyldecyl, 2-(1,3,3-trimethylbutyl)-5,7,7-trimethyloctyl and the like.

Further, the preferable alkylene group represented by $R_1$ in the naphthoic acid esters, $R_2$ in the naphthyl ethers or $R_3$ in the naphthol esters, includes ethylene, trimethylene, tetramethylene, pentamethylene, hexamethylene, heptamethylene, octamethylene, nonamethylene, decamethylene, undecamethylene, dodecamethylene, tridecamethylene, tetradecamethylene, pentadecamethylene, hexadecamethylene, heptadecamethylene, octadecamethylene, nonadecamethylene, eicosamethylene, 1-methyltrimethylene, ethylethylene, 1-methyltetramethylene, 1-ethyltrimethylene, 1-methylpentamethylene, 1-ethyltetramethylene, 1-methylhexamethylene, 1-ethylpentamethylene, 1-methylheptamethylene, 1-ethylhexamethylene, 1-methyloctamethylene, 1-ethylheptamethylene, 1-methylnonamethylene, 1-ethyloctamethylene, 1-methyldecamethylene, 1-ethylnonamethylene, 1-methylundecamethylene, 1-ethyldecamethylene, 1-methyldodecamethylene, 1-ethylundecamethylene, -methyltridecamethylene, 1-ethyldodecamethylene, 1-methyltetradecamethylene, 1-ethyltridecamethylene, 1-methylpentadecamethylene, 1-ethyltetradecamethylene, 1-methylhexadecamethylene, 1-ethylpentadecamethylene, 1-methylheptadecamethylene, 1-ethylhexadecamethylene, 1,1-dimethylethylene, 1,1-dimethyltrimethylene, 1,1-dimethyltetramethylene, 1,1-dimethylpentamethylene, 1,1-dimethylhexamethylene, 1,1-dimethylheptamethylene, 1,1-dimethyloctamethylene, 1,1-dimethylnonamethylene, 1,1-dimethyldecamethylene, 1,1-dimethylundecamethylene, 1,1-dimethyldodecamethylene, 1,1-dimethyltridecamethylene, 1,1-dimethyltetradecamethylene, 1,1-dimethylpentadecamethylene, 1,1-dimethylhexadecamethylene and the like.

The naphthoic acid esters, naphthyl ethers and naphthol esters which may be used in this invention, are those as specified above. The synthetic lubricating oil of this invention comprises as the main component at least one member selected from the group consisting of the specified naphthoic acid esters, naphthyl ethers and naphthol esters. These three kinds of compounds may be synthesized by any suitable method. The naphthoic acid ester may usually be obtained by the esterifying reaction of naphthoic acid with an alcohol. More particularly, naphthoic acid is reacted with a monohydric alcohol having 1–20 carbon atoms and a dihydric alcohol having 2–20 carbon atoms at a reaction temperature of 100°–180° C. in the presence of an acid catalyst such as sulfuric acid to obtain the specified naphthoic acid ester.

The naphthol ester may usually be synthesized by the esterifying reaction of naphthol with a carboxylic acid or a derivative thereof. For example, naphthol is reacted with carboxylic chloride at room temperature to obtain the naphthol ester.

An alkylnaphthyl ether, which is one of naphthyl ethers, may usually be obtained by the Williamson synthesis. More particularly, naphthol is treated to synthesize sodium naphthoxide which is then reacted with an alkyl halide under heat to obtain the naphthyl ether.

An alkylphenyl naphthyl ether, which is one of naphthyl ethers, may usually be obtained by the Ullmann reaction. More particularly, a halogenated naphthalene is heated to react with an alkylphenol in the presence of a catalyst such as copper, copper oxide (I), copper halide (I), copper iodide (I) or iron chloride (III) thereby to obtain the alkylphenyl naphthyl ether.

An example of the novel specified naphthoic acid esters is the one wherein $X_1$ is 2-(1,3,3-trimethylbutyl)-5,7,7-trimethyloctyl group and is 2-(1,3,3-trimethylbutyl)-5,7,7-trimethyloctyl-1naphthoate represented by

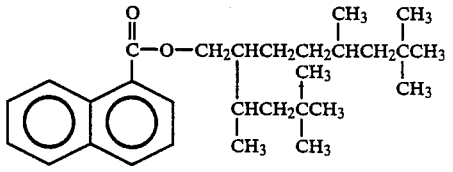

This naphthoate may be produced by any suitable method and, as mentioned above, it may be obtained by esterifying naphthoic acid with an alcohol. More particularly, it may be produced by reacting α-naphthoic acid with 2-(1,3,3-trimethylbutyl)-5,7,7-trimethyloctanol at a reaction temperature of 100°–180° C. in the presence of an acid catalyst such as sulfuric acid.

The novel specified naphthyl ethers include o-sec.-butylphenyl-1-naphthyl ether represented by the formula

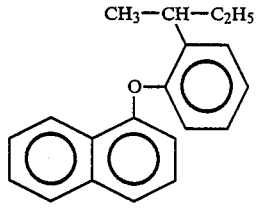

This exemplary ether may be produced by any suitable method. For example, it may usually be obtained by the Ullmann reaction as mentioned above. More particularly, it is obtained by thermally reacting an α-halogenated naphthalene with α-sec.-butylphenol in the presence of a catalyst such as copper, copper oxide (I), copper chloride (I), copper iodide (I) or iron chloride (III).

The synthetic lubricating oil of this invention comprising as the main ingredient at least one member selected from the novel specified naphthoic acid esters, naphthyl ethers and naphthol esters, has itself various properties as required for ordinary lubricating oils, and particularly excellent oxidation stability. As required, the synthetic lubricating oil, however, may be incorporated with ordinarily-used known additives for lubricating oils such as an antioxidant, detergent-dispersant, viscosity index improver, pour point depressant, oiliness-providing agent, wear-resisting agent, extreme-pressure agent, anti-corrosive agent, metal-deactivator, anti-rust agent, anti-foaming agent, emulsifier, demulsifier, bactericide and colorant. These various additives are described in detail in, for example, Junkatsuyu Gakkaishi (Journal of Lubricating Oil Society) Vol. 15, No.

6 or Sekiyuseihin Tenkazai (Additives for Petroleum Products) by Toshio Sakurai and published by Saiwai Bookstore. The total amount of these various additives is up to 10 wt. %, preferably up to 5 wt. % and more preferably up to 3 wt. %, of the total amount of the lubricating oil.

The synthetic lubricating oil of this invention may be incorporated, as required, with mineral oils and known synthetic lubricating oils in such an amount that the high oxidation stability thereof is not impaired. The known synthetic lubricating oils include polybutene, α-olefin oligomers, alkylbenzenes, alkylnaphthalenes, diesters, polyol esters, polyglycol, polyphenyl ethers, tricresyl phosphate, silicone oil and perfluoroalkyl ethers. These known synthetic lubricating oils may be added to the new lubricating oil of this invention in an amount of up to 50 wt. %, preferably up to 30 wt. % and more preferably up to 20 wt. %, of the total of he known and new synthetic lubricating oils.

The synthetic lubricating oils of this invention may be used as a gasoline engine oil, land diesel engine oil, marine diesel engine, turbine oil (without additives), turbine oil (with additives), gas turbine oil, marine turbine oil, automobile gear oil, industrial gear oil, gear oils such as automatic transmission oil, hydraulic working oil, compressor oil, refrigerator oil, cutting oil, grinding oil, plasticity working oil, heat treating oil, metal working oil such as discharge working oil, slide guiding surface oil, bearing oil or the like.

PREFERRED EMBODIMENTS OF THE INVENTION

Figure 1:
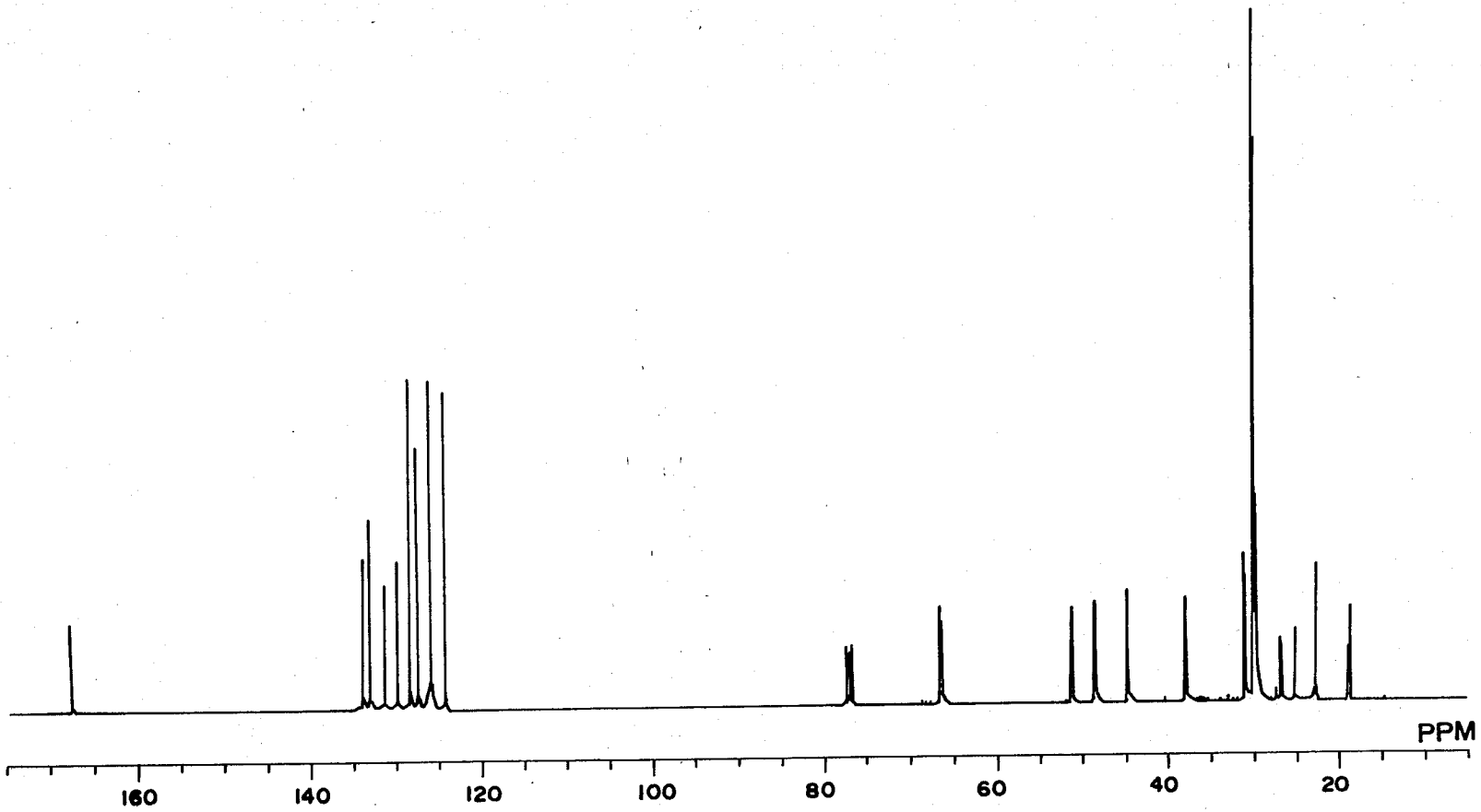
FIG. 1 shows the $^{13}C$ NMR spectra of 2-(1,3,3-trimethylbutyl)-5,7,7-trimethyloctyl-1naphthoate of this invention.

This invention will be better understood by the following Examples and Comparative Examples.

EXAMPLE 1

One mol (172 g) of α-naphthoic acid, 1.5 mol (195 g) of octyl alcohol and 3 ml of conc. $H_2SO_4$ were charged into a four-necked flask, and the whole was heated to 120° C. under agitation for 5 hours in a nitrogen atmosphere. After the end of the reaction, the resulting reaction mixture was cooled, freed from the water, sulfuric acid, unreacted naphthoic acid and alcohol by the use of a separating funnel and then distilled under a reduced pressure to obtain 230 g of octyl-1-naphthoate having a boiling point of 200°–202° C./4 mmHg.

The thus obtained octyl-1-naphthoate was evaluated for its performances. The results are as shown in Table 1.

Viscosity

The thus obtained naphthoate was measured for its kinematic viscosity at 40° C. and 100° C. in accordance with the method of test for kinematic viscosity on crude oils and petroleum products, prescribed in JIS K 2283.

Oxidation Resistance

The thus obtained naphthoate was subjected to the rotary bomb oxidation test prescribed in JIS K 2514–3.3. Oxidation resisting capacity was evaluated in terms of a time taken until the oxidation pressure decreased by 1.8 kg/cm$^2$. The test conditions were as follows:

Test temperature: 150° C.
Oxygen pressure: 13 kg/cm$^2$
Catalyst: Copper wire 1.60 mm Φ

EXAMPLE 2

The procedure of Example 1 was followed except that dodecyl alcohol was substituted for the octyl alcohol, thereby to obtain 241 g of dodecyl-1-naphthoate having a boiling point of 240°–244° C./5 mmHg.

The thus obtained dodecyl-1-naphthoate was evaluated for performances in the same manner as in Example 1 with the results being shown in Table 1.

EXAMPLE 3

The procedure of Example 1 was followed except that 2-(1,3,3-trimethylbutyl)-5,7,7trimethyloctyl alcohol was substituted for the octyl alcohol, thereby to obtain 192 g of 2-(1,3,3-trimethylbutyl)-5,7,7-trimethyloctyl-1-naphthoate. The naphthoate so obtained had a boiling point of 246°–248° C./4 mmHg.

This naphthoate was evaluated for performances in the same manner as in Example 1, and the results are as indicated in Table 1.

Figure 2:
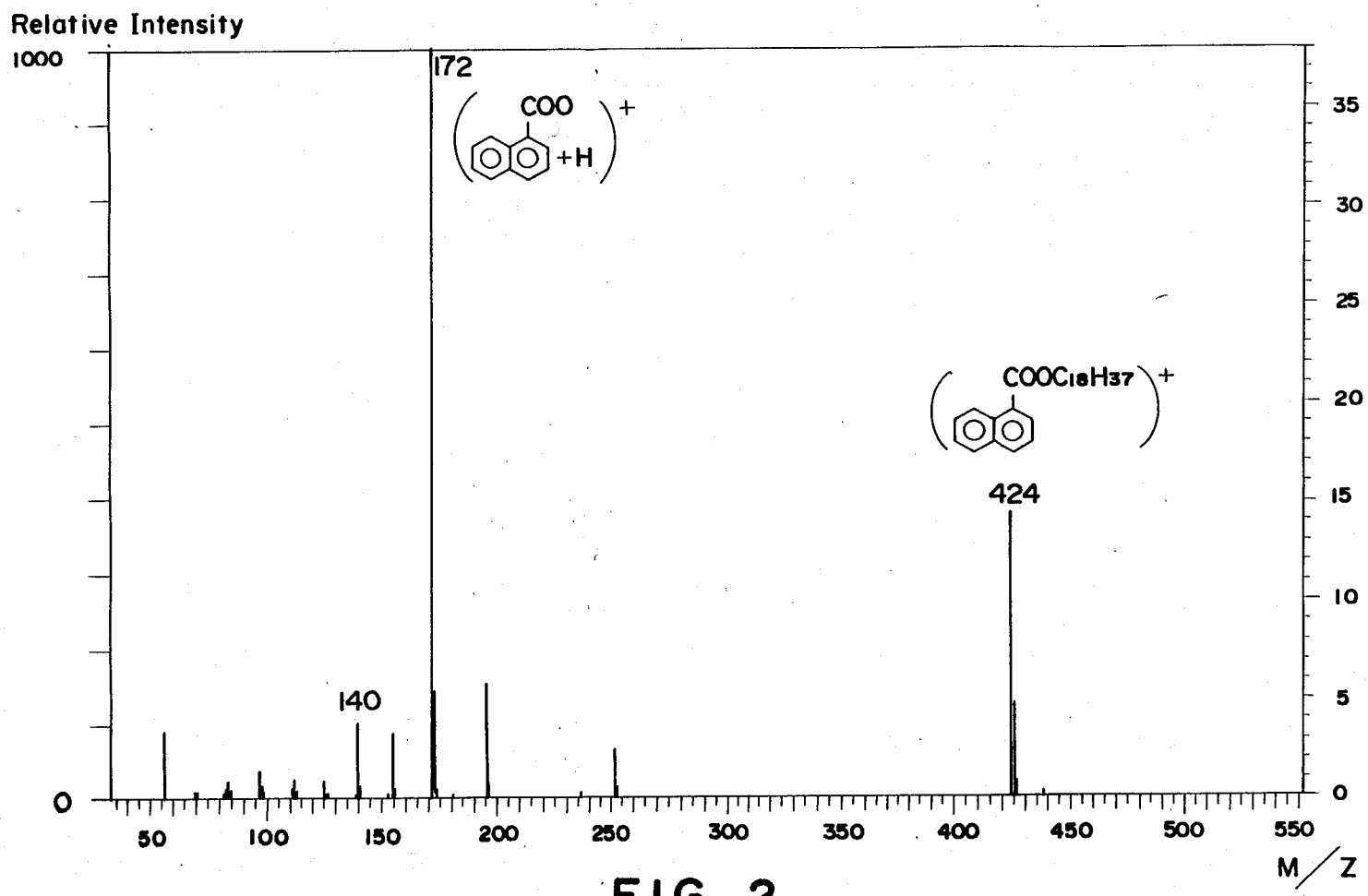
FIG. 2 shows the mass spectra of the above naphthoate.

This compound was identified as 2-(1,3,3-trimethylbutyl)-5,7,7-trimethyloctyl-1-naphthoate by means of $^{13}C$ NMR and mass spectrography. FIG. 1 shows the $^{13}C$ NMR spectra of the above naphthoate, and FIG. 2 the mass spectra thereof.

EXAMPLE 4

The procedure of Example 1 was followed except that 2-ethylhexyl alcohol was used in substitution for the octyl alcohol, thereby to obtain 240 g of 2-ethylhexyl-1-naphthoate having a boiling point of 198°–200° C./3 mmHg.

The naphthoate so obtained was evaluated for performances in the same manner as in Example 1 with the results being indicated in Table 1.

EXAMPLE 5

One mol (1 mol) of α-naphthol and 300 ml of ethanol were charged into a flask to dissolve the α-naphthol in the ethanol therein, after which the resulting solution was incorporated dropwise with 300 ml of ethanol wherein one mol of sodium hydroxide had been dissolved, at room temperature over a period of time of two hours. After the end of dropwise incorporation, the whole was agitated at room temperature for one hour, distilled to remove the ethanol by distillation off, incorporated with 300 ml of benzene to dissolve the precipitates and incorporated dropwise with 150 g of 2-ethylhexanoyl chloride over a period of time of two hours. After the end of the incorporation, the whole was further agitated at room temperature for one hour to obtain a reaction mixture which was neutralized with an aqueous solution of sodium carbonate, washed with water and then distilled at a reduced pressure thereby to obtain 80 g of an end product represented by the formula

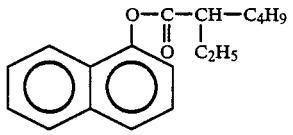

The thus obtained end product had a boiling point of 184°-189° C./6 mmHg.

This product was evaluated for performances in the same manner as in Example 1, and the results are as shown in Table 1.

EXAMPLE 6

One mol (1 mol) of α-naphthol and 300 ml of ethanol were charged into a flask to dissolve therein the α-naphthol under agitation, after which the resulting solution was incorporated dropwise with 300 ml of ethanol wherein one mol of sodium hydroxide had been dissolved, at room temperature over a period of time of one hour. After the end of the incorporation, the whole was heated, incorporated dropwise with one mol of octyl chloride over a period of time of one hour and then continued to be refluxed for further 3 hours. After the completion of the reaction, the reaction mixture was freed from the ethanol by distillation off, neutralized with sodium carbonate, washed with water and then distilled at a reduced pressure, thereby to obtain 180 g of an end product represented by the formula

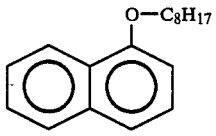

The end product so obtained had a boiling point of 183°-185° C./4 mmHg. It was evaluated for its performances in the same manner as in Example 1 with the results being shown in Table 1.

EXAMPLE 7

The procedure of Example 6 was followed except that β-naphthol was substituted for the α-naphthol, thereby to obtain 140 g of an end product represented by the formula

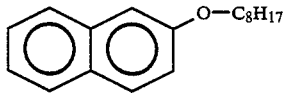

The end product so obtained had a boiling point of 184°-187° C./7 mmHg. It was then evaluated for its performances in the same manner as in Example 1, and the results are as shown in Table 1.

EXAMPLE 8

One mol (1 mol) of α-bromonaphthalene, 1.3 ml of α-sec.-butylphenol, 0.5 mol of copper oxide (I) and 2 mol of γ-collidine were charged into a flask, heated and refluxed for 6 hours. After the end of the reaction, the reaction mixture was cooled to room temperature and filtered to obtain a filtrate which was then distilled at a reduced pressure thereby to obtain 120 g of an end product represented by the formula

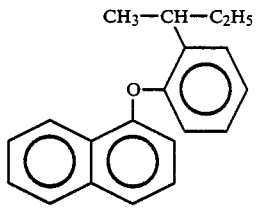

The end product so obtained had a boiling point of 187°-192° C./5 mmHg. It was evaluated for its performances in the same manner as in Example 1 with the results being shown in Table 1.

Figure 3:
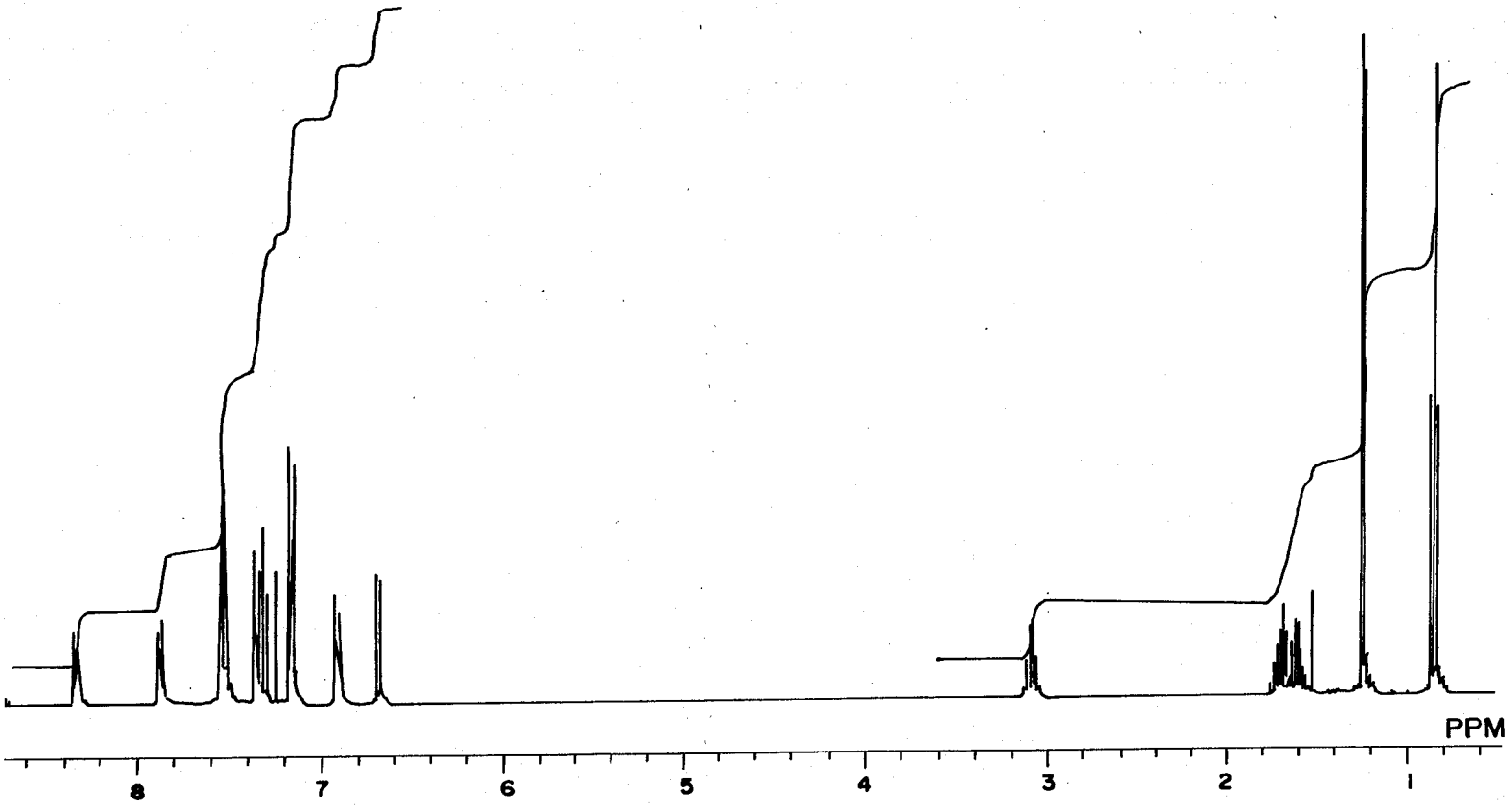
FIG. 3 shows $^{1}H$ NMR spectra of α-sec.-butylphenyl-1-naphthyl ether of this invention.
Figure 4:
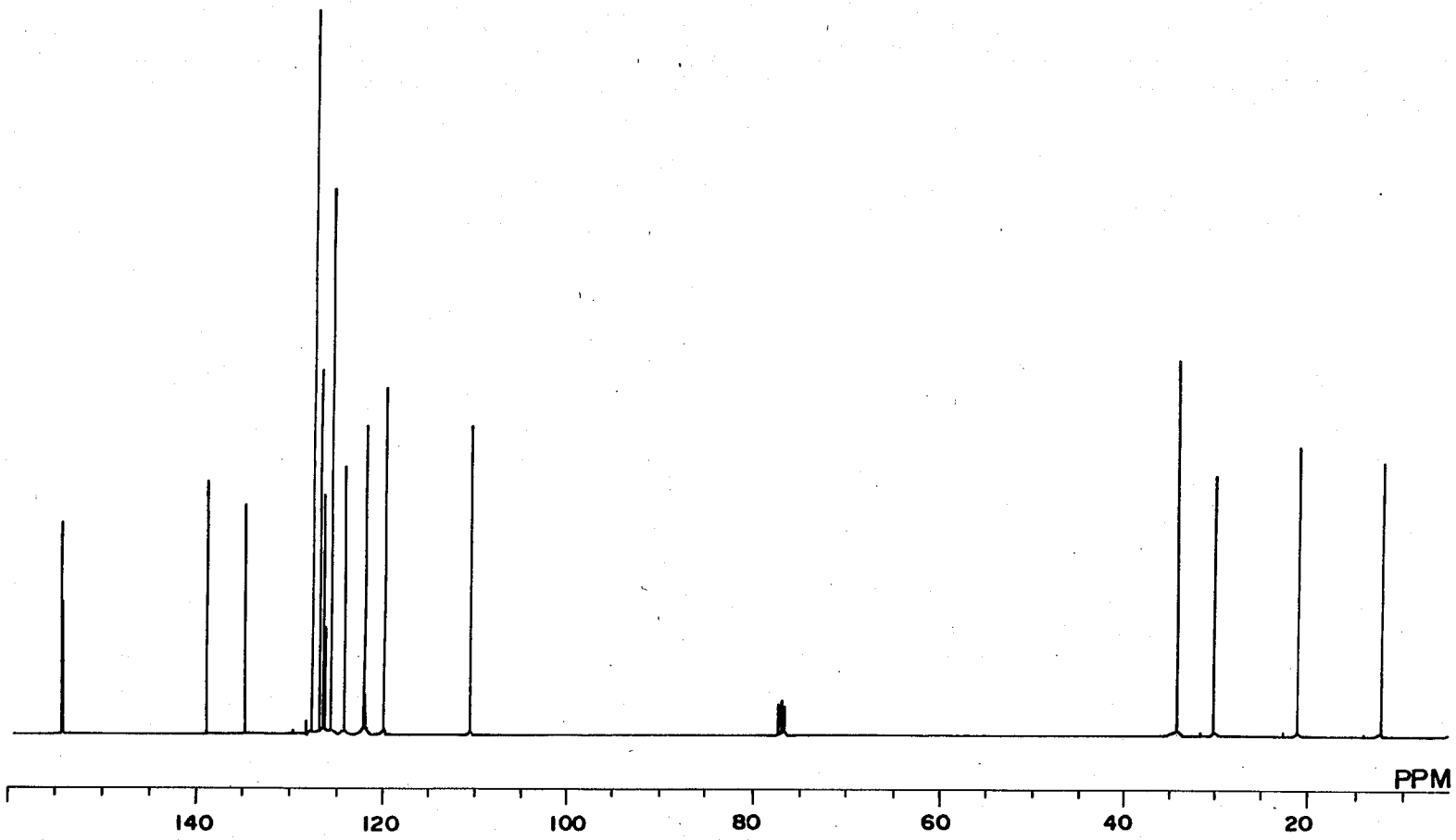
FIG. 4 shows the $^{13}C$ NMR spectra of the above naphthyl ether.
Figure 5:
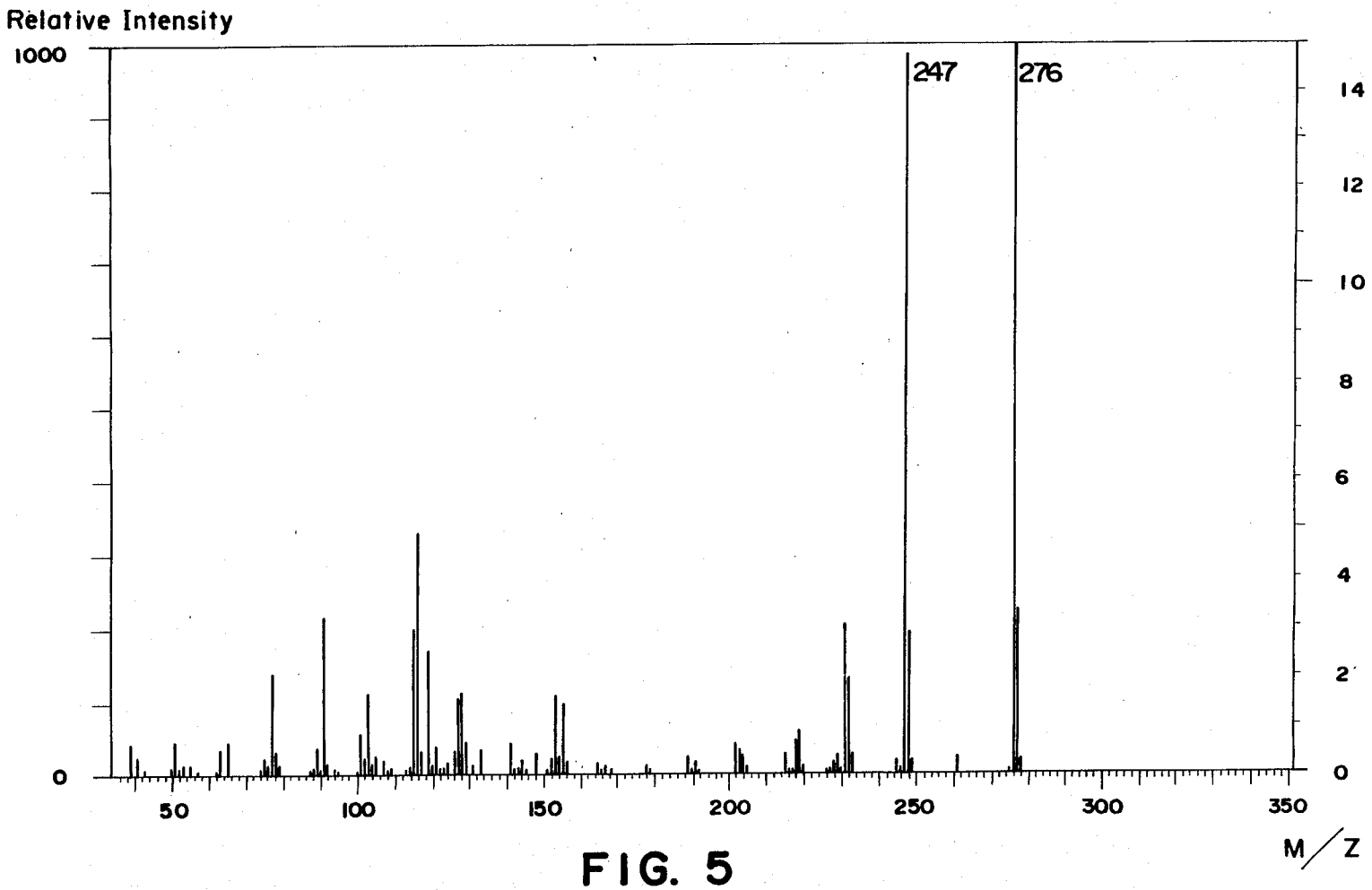
FIG. 5 shows the mass spectra of the above naphthyl ether.

This end product was identified as o-sec.-butylphenyl-1-naphthyl ether by $^{1}H$ NMR spectra, $^{13}C$ NMR and mass spectra. FIG. 3 shows the 1H NMR spectra, FIG. 4 the $^{13}C$ NMR spectra and FIG. 5 the mass spectra.

EXAMPLE 9

The procedure of Example 8 was followed except that p-sec.-butylphenol was substituted for the o-sec.-butylphenol, thereby to obtain 125 g of an end product represented by the formula

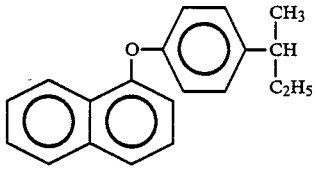

The thus obtained end product had a boiling point of 198°-201° C./4 mmHg. It was evaluated for its performances in the same manner as in Example 1, and the results are shown in Table 1.

COMPARATIVE EXAMPLES 1-4

A 1-decene oligomer having an average molecular weight of 500 heretofore used as a synthetic lubricating oil (Comparative Example 1), dinonyl adipate (Comparative Example 2), pentaerithritol tetracapriate (Comparative Example 3) and dialkylbenzene wherein the total carbon number of the alkyl groups is 12-24 (Comparative Example 4), were evaluated for their oxidation stability in the same manner as in Example 1. The results are shown in Table 1.

TABLE 1

| | Kinematic viscosity (cSt) | | Oxidation stability |
|---|---|---|---|
| | 40° C. | 100° C. | (min) |
| Example 1 | 10.70 | 2.558 | 3720 |
| Example 2 | 15.20 | 3.215 | 2900 |
| Example 3 | 146.4 | 8.194 | 2200 |
| Example 4 | 12.22 | 2.255 | 6480 |
| Example 5 | 14.63 | 2.595 | 2670 |
| Example 6 | 9.34 | 2.188 | 1450 |
| Example 7 | 11.43 | 2.407 | 380 |
| Example 8 | 44.36 | 4.117 | 7000 |
| Example 9 | 26.38 | 3.573 | 123 |
| Comp. Example 1 | 33.04 | 6.00 | 30 |
| Comp. Example 2 | 13.3 | 3.42 | 82 |
| Comp. Example 3 | 32.7 | 6.37 | 97 |
| Comp. Example 4 | 65.7 | 6.34 | 33 |

As is apparent from the results of the oxidation stability test, the new synthetic lubricating oils comprising one of the naphthoic acid esters (Examples 1–4), the naphthyl ethers (Examples 8–9) and the naphthol esters (Examples 5–7), exhibit very excellent hightemperature oxidation stability, whereas the lubricating oils comprising one of poly-α-olefins, diesters, polyesters and alkylbenzenes (Comparative Examples 1–4), which have been said to be excellent in oxidation stability, are very inferior in oxidation stability to the lubricating oils (Examples 1–9).

As so far mentioned, the new synthetic lubricating oils of this invention comprising as the main ingredient at least one member selected from the group consisting of the naphthoic acid esters, naphthyl ethers and naphthol esters, have such high oxidation stability that the conventional known synthetic lubricating oils would not attain.

What is claimed is:

1. A synthetic lubricating oil comprising as the main component a naphthoic acid ester represented by the general formula

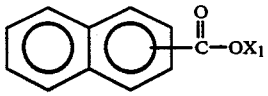

wherein $X_1$ is an alkyl group having 1–20 carbon atoms, or a group having the general formula

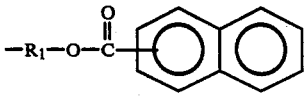

in which $R_1$ is an alkylene group having 2–20 carbon atoms.

2. A synthetic lubricating oil comprising as the main component a naphthyl ether represented by the general formula

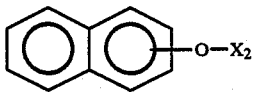

wherein $X_2$ is an alkyl group having 1–20 carbon atoms, a phenyl group, a monoalkylphenyl group having 7–26 carbon atoms, or a group having the general formula

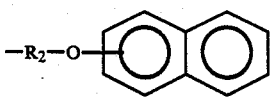

in which $R_2$ is an alkylene group having 2–20 carbon atoms.

3. A synthetic lubricating oil comprising as the main component a naphthol ester represented by the general formula

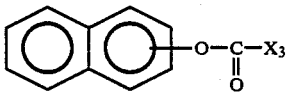

wherein $X_3$ is an alkyl group having 1–20 carbon atoms, or a group having the general formula

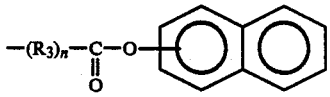

in which $R_3$ is an alkylene group having 1–20 carbon atoms and n is 0 or 1.

4. The oil according to claim 1 which is 2-(1,3,3-trimethylbutyl)-5,7,7-trimethyloctyl-1naphthoate represented by the formula

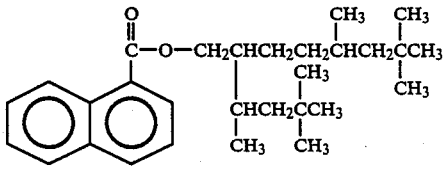

5. The oil according to claim 2 which is o-sec.-butylphenyl-1-naphthyl ether represented by the formula

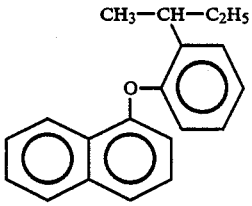

6. A synthetic lubricating oil comprising as the main components (1) a naphthoic acid ester of formula

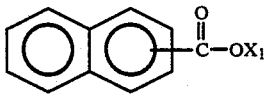

wherein $X_1$ is alkyl having 1–20 carbon atoms, or a group having the formula

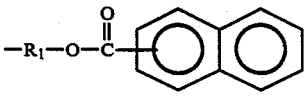

in which $R_1$ is alkylene having 2–20 carbon atoms and (2) a naphthyl ether of formula

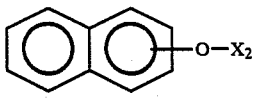

wherein $X_2$ is alkyl having 1–20 carbon atoms, phenyl, monoalkylphenyl having 7–26 carbon atoms or a group of formula

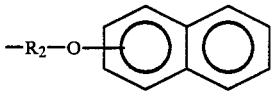

in which $R_2$ is alkylene of 2–20 carbon atoms.

7. A synthetic lubricating oil comprising as the main components (1) a naphthyl ether of formula

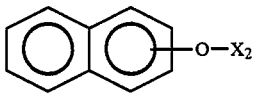

wherein $X_2$ is alkyl having 1–20 carbon atoms, phenyl, monoalkylphenyl having 7–26 carbon atoms or a group having the general formula

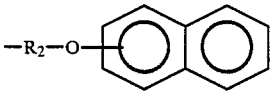

in which $R_2$ is alkylene having 2–20 carbon atoms, and (2) a naphthol ester of formula

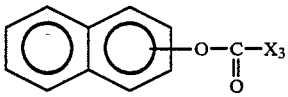

wherein $X_3$ is alkyl having 1–20 carbon atoms, or a group having the formula

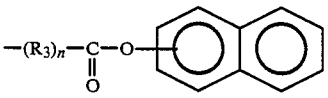

in which $R_3$ is alkylene having 1–20 carbon atoms and n is 0 or 1.

8. A synthetic lubricating oil comprising as the main components (1) a naphthoic acid ester of formula

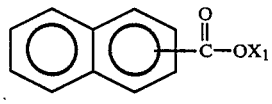

wherein $X_1$ is alkyl having 1–20 carbon atoms, or a group having the formula

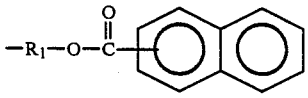

in which $R_1$ is alkylene having 2–20 carbon atoms, and 2) a naphthol ester of formula

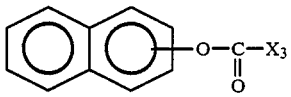

wherein $X_3$ is alkyl having 1–20 carbon atoms, or a group having the formula

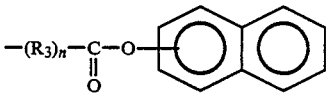

in which $R_3$ is alkylene having 1–20 carbon atoms and n is 0 or 1.

9. A synthetic lubricating oil comprising as the main components (1) a naphthoic acid ester of formula

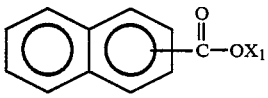

wherein $X_1$ is alkyl having 1–20 carbon atoms, or a group having the general formula

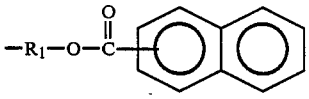

in which $R_1$ is alkylene having 2–20 carbon atoms, and (2) a naphthyl ether of formula

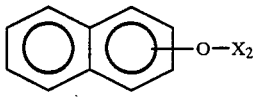

wherein $X_2$ is alkyl having 1–20 carbon atoms, phenyl, monoalkylphenyl having 7–26 carbon atoms or a group having the formula

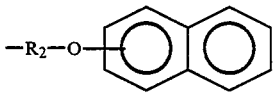

in which $R_2$ is alkylene having 2–20 carbon atoms, and (3) a naphthol ester of formula

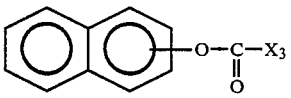

wherein $X_3$ is alkyl having 1–20 carbon atoms, or a group having the general formula

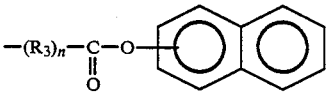

in which $R_3$ is alkylene having 1–20 carbon atoms and n is 0 or 1.

* * * * *